US005915373A

United States Patent [19]

Malover et al.

[11] Patent Number: 5,915,373

[45] Date of Patent: Jun. 29, 1999

[54] GOLF BALL WARMER

[75] Inventors: Raymond J. Malover, Southfield; Merle Van Norman, St. Clair Shores, both of Mich.

[73] Assignee: Finding Devices, Inc., Southfield, Mich.

[21] Appl. No.: 08/906,664

[22] Filed: Aug. 7, 1997

[51] Int. Cl.[6] ..... F24J 3/00

[52] U.S. Cl. ..... 126/263.02; 126/263.01

[58] Field of Search ..... 126/263.01, 263.02

[56] References Cited

U.S. PATENT DOCUMENTS

| | | | |
|---|---|---|---|
| 1,659,185 | 2/1928 | Baker | 126/263.02 |
| 2,181,821 | 11/1939 | Seals | 126/236.01 |
| 3,773,461 | 11/1973 | Arimoto et al. | 126/263.01 |
| 4,545,362 | 10/1985 | Hendricks | 126/263.01 |
| 4,967,062 | 10/1990 | Cohen | 219/521 |
| 5,137,011 | 8/1992 | Roth | 126/263.01 |
| 5,460,160 | 10/1995 | Parrott | 126/263.01 |

*Primary Examiner*—Larry Jones
*Attorney, Agent, or Firm*—Young & Basile, P.C.

[57] ABSTRACT

A golf ball warmer including a fabric container for housing a commercial hand warmer that is activated by contact of air. The fabric container is cubical in shape to house the hand warmer and golf balls, and having a floor for receiving one of the hand warmers. A back surface of the container extends above an opening of the container to form a closing flap. A mesh fabric pocket is stitched to the inside of the flap for receiving another hand warmer. The container can house two golf balls on the warmer disposed on the floor of a container. When the flap is closed the mesh fabric pocket is placed over the top of the golf balls.

11 Claims, 2 Drawing Sheets

GOLF BALL WARMER

FIELD OF THE INVENTION

The invention relates to a heating device for golf balls.

BACKGROUND OF THE INVENTION

It is known that golf balls demonstrate a significant increase in travel distance when struck with a golf club when the golf ball is heated above 90° F. In the warm climates this does not pose a problem, but in northern regions, golfers are increasingly golfing in the early spring and late autumn when ambient temperatures can be very low. To maintain a consistent game throughout the entire year, golfers in the northern regions have employed various golf ball heating devices.

The prior art discloses a number of golf ball heaters. Most of the heaters include containers for the golf balls in which the golf balls are subject to forced hot air. The containers are large, in order to encompass a plurality of golf balls and a heating unit which includes a blower or fan for circulation of the heat. With this type of heater, the size of the container necessarily requires using a golf cart for carrying the cumbersome container.

Another type of heating device for golf balls is disclosed in U.S. Pat. No. 5,137,011 issued on Aug. 11, 1992. This patent incorporates a chemical heating device inserted with the golf balls into a thermally insulated container. The container is a rigid body having apertures therethrough to provide admittance of ambient air for activation of the chemical heating device. A similar device is disclosed in U.S. Pat. No. 4,545,362 issued on Oct. 8, 1985. This invention uses a commercial hand warmer that is placed within a sectional housing having apertures therethrough for admitting ambient air into the interior of the container to activate the warmer. In both of the aforementioned disclosures, the housing is rigid and solid requiring apertures to be placed therethrough to provide an access means for ambient air to the chemical warming device. The rigid constraints of the aforementioned containers do not allow for easy storage in a golf bag or on the golfer's person.

SUMMARY OF THE INVENTION

The present invention provides a golf ball heater having a flexible and foldable container such that the golf ball heater can be easily stored in a golfer's pocket, his golf bag or on his belt loop. When not in use, the container collapses even further to be relatively flat. The golf ball heater includes a container made of an air permeable cloth material having a cubical shape lower portion with a flap closure. The flap extends above an open end. The lower portion provides a flat surface for positioning of a commercial chemical hand warmer. On the inside surface of the flap, there is an open weave pouch made of a cloth material for providing a cavity for holding another commercial chemical hand warmer. A couple of golf balls can be placed on top of a chemical hand warmer located on the lower flat surface of the container. The other chemical hand warmer moves onto the top of the balls when the flap is extended over the open end and is fastened to the bottom portion of the container. Air is allowed to flow in and out of the golf ball warmer container through the air permeable material such that the air activates the chemical within the hand warmer device to warm the golf balls to a desirable temperature range.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
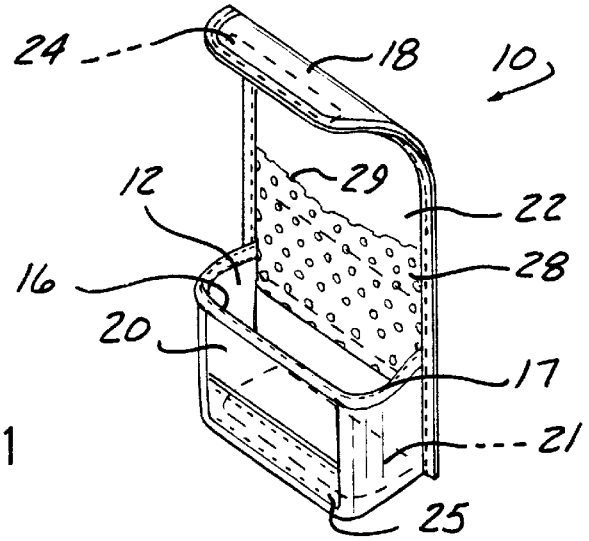
FIG. 1 shows a prospective view of the golf ball warming device of the present invention in the open position.

The golf ball warming device 10 of the present invention is shown in FIGS. 1 through 5 having a cubical configuration. The golf ball warming device 10 includes a container 12 that is made of a cloth material such as cotton duck or cotton twill or a blend of polyester and cotton. The cloth material allows the golf ball warmer to be easily folded when not in use. The back side 14 of the cubical container extends above an open end 16 to form a flap 18 that can be folded over the open end 16 of the container 12 and secured to the front side 20 of the container 12. The open end 16 provides an entrance to the interior of the container which includes a lower flat surface or floor 21. The inside surface 22 of the flap 18 at its uppermost end is a fastening means 24 such as a Velcro™ hook and loop. On the outside surface of the front side 20 of the container 12 and located at a lower portion is a corresponding attachment means 25 for the fastening means 24 on the flap 18. The fastening means 24 and its corresponding attachment means 25 is preferably the Velcro™ type fastener but may also be snaps, buttons, or other similar fastening means.

Figure 2:
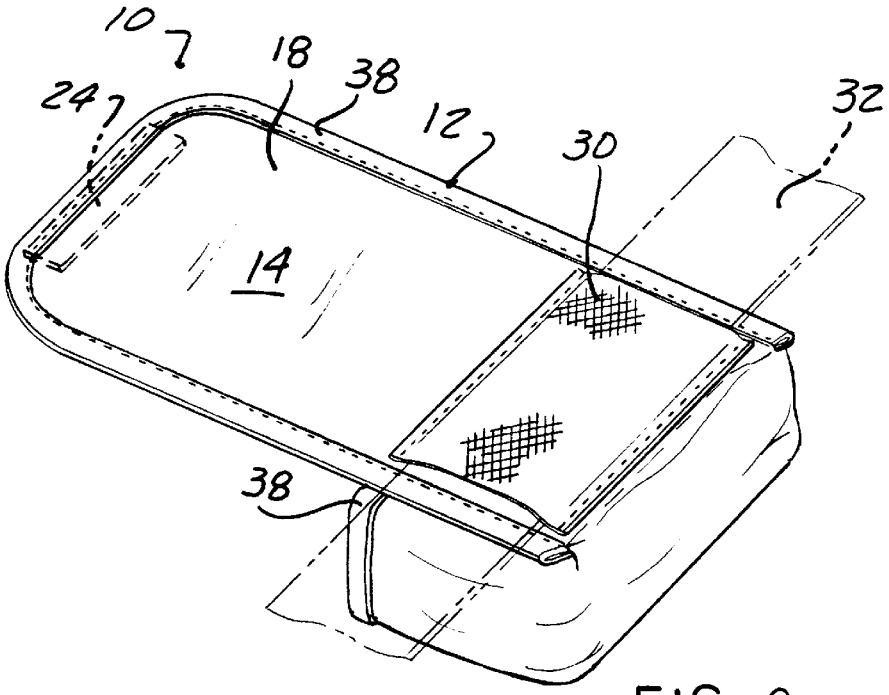
FIG. 2 is a perspective view of the back and bottom of the golf ball warming device.

An open weave or mesh cloth is sewn along its three sides onto the inner surface 22 of the flap 18 to form a pocket or pouch 28. The bottom portion of the open weave pouch 28 is folded over and extends slightly below the open top rim 17 within the container before it is stitched against the inside surface or back wall 22 of the flap 18. The open weave pocket 28 is open at a top end 29. A belt loop 30 (two are shown in FIG. 2) may be stitched onto the back surface 14 of the container 12 with bias tape material in such a way that the golf warmer container 12 may be looped over a belt or strap 32 to secure it onto a golf bag strap or golfer's belt.

Figure 4:
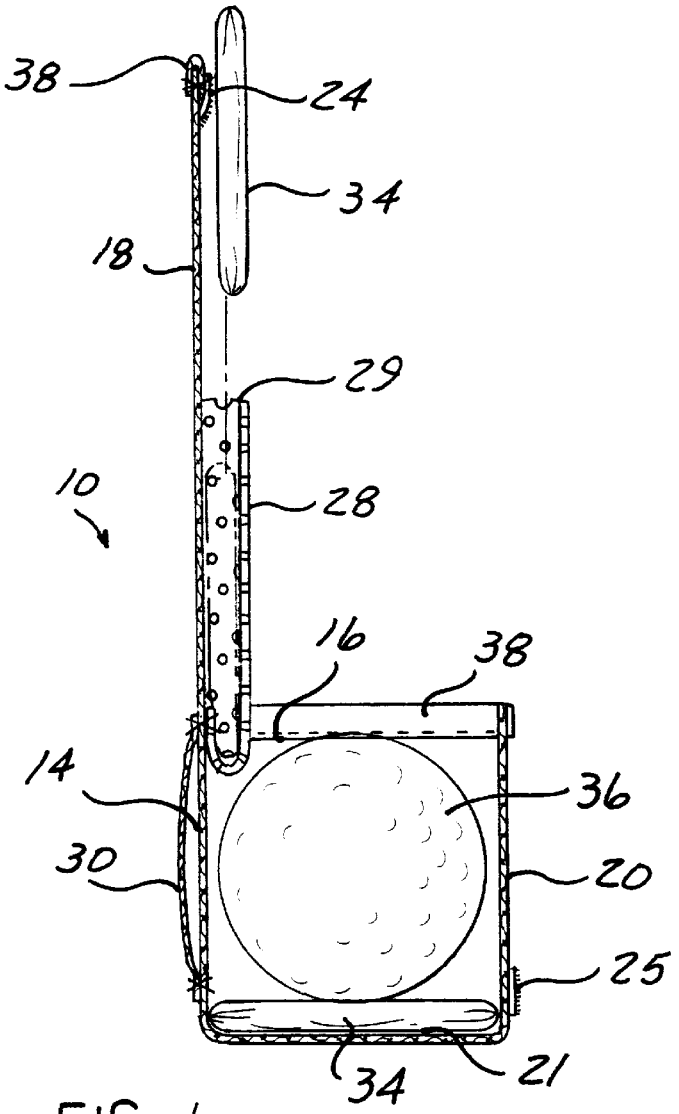
FIG. 4 is a side cut-away view of the golf ball warming device in the open position.

The warmer 34 for the golf ball 36 is preferably a disposable type known in the industry. One manufacturer is HOTHANDS-2 distributed by HEATMAX Incorporated of Dalton, Ga. Other manufacturers also provide a similar type warmer 34 which is activated with contact of air on its outer surface. Two such warmers 34 are placed within the fabric container 12. A first warmer 34 is placed on the floor 21 of the container 12. The interior of the container 12 is sized to accommodate this type of hand warmer 34 and also for placement of two golf balls 36 thereupon. A second warmer 34 is then placed through the top end of the pocket 29 and into the mesh fabric pocket 28, as indicated in FIG. 4.

Figure 3:
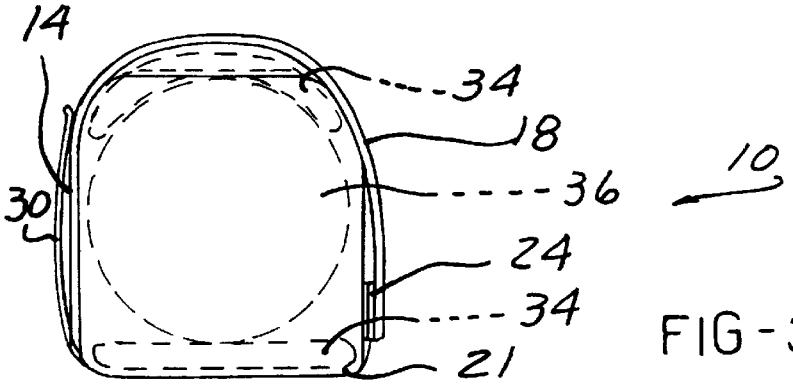
FIG. 3 is a side elevational view of the golf ball warming device in the closed position.
Figure 5:
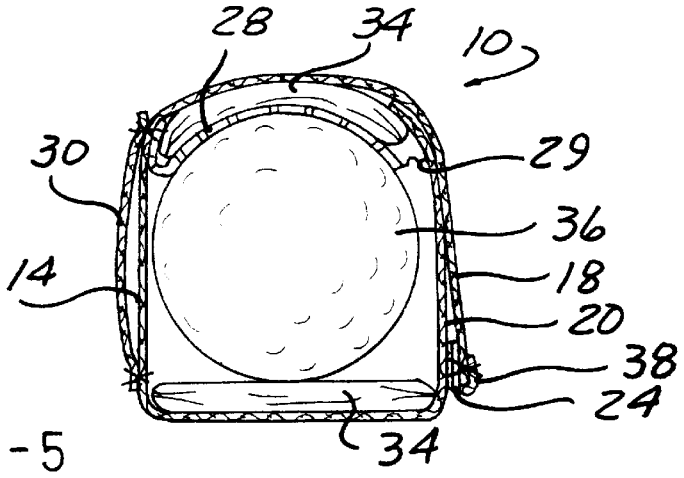
FIG. 5 is a side cut-away view of the golf ball warming device in the closed position.

When the flap 18 is closed over the opening 16 of the container 12 and secured by the fastening means 24 and 25, the warmer 34 in the mesh pocket 28 is positioned directly over the golf balls 36 (as shown in FIGS. 3 and 5). The warmer 34 is flexible so that it can mold to the shape of the container 12 or the golf balls 36. As a result, much of the surface area of the golf balls 36 is exposed to the warmers 34. The warmer 34 is generally pre-packaged by the manufacturer in a container void of air to preclude activation of the warmer until it is desired to transmit the heat for its desired application. When it is desired to heat the golf balls 36, the warmer 34 can be removed from its pre-packaged container and placed in the appropriate locations of the floor 21 of the fabric container 12 and within the pouch 28.

The cloth material that is used for construction of the golf ball warmer 10 provides adequate air permeability so that ambient air has access to the warmers 34. Air is necessary to activate the chemicals in the warmers 34 to produce heat. Various fabrics were tested to determine the fabric which would provide the balance of allowing enough air through the container 12 to activate the warmers 34, and also a fabric for trapping and preventing the heat from escaping the container 12. To accomplish these requirements, a seven ounce cotton duck or cotton twill fabric material is used for the container 12. The material is a 50% cotton and 50% polyester blend having a heat set crease resistant finish. This heat set crease resistant finish further aids in heat retention. The fabric material also features a Grieg Goods thread count of $^{80}/_{42}$. The open weave or mesh pouch 28 allows sufficient heat to be absorbed to the upper portions of the golf balls 36.

The container 12 is easily manufactured. The main structure of the container is a one piece unit that is die cut. Corresponding edges are stitched together to provide the cubical configuration. A bias tape 38 material is stitched along the edges of the back side 14 and flap 18 of the container to provide an aesthetic and finished look and also to provide strength to the container. At the top rim 17, the bias tape 38 may also be stitched on the inside of the container. Another bias tape 38 is stitched along the open top rim 17.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A golf ball warming device comprising:

a cubical container made of a fabric material and forming an interior cavity, wherein the cubical container is constructed from a one piece die cut material; and a flexible warmer activated by contact of air, wherein said warmer is disposed in the cavity of the container.

2. The golf ball warming device comprising:

a cubical container made of a fabric material and forming an interior cavity; and a flexible warmer activated by contact of air, wherein said warmer is disposed in the cavity of the container;

wherein the cubical container includes an open end and a flap for selectively closing said open end, said flap having an inside surface and exterior surface, and wherein said cubical container further including a pouch made of flexible material attached to the inside surface of the flap for receiving another warmer.

3. The golf ball warming device of claim 2, wherein the interior cavity includes a floor for placement of the warmer.

4. The golf ball warming device of claim 3, wherein the interior cavity is dimensioned for receiving a pair of golf balls on the warmer.

5. The golf ball warming device of claim 2, wherein the pouch is made of a mesh fabric material.

6. The golf ball warming device of claim 2, wherein the pouch is made of a flexible open weave material.

7. The golf ball warming device of claim 2, wherein the exterior surface of the flap has a fastening means for securing said golf ball warming device to a belt or strap.

8. The golf ball warming device of claim 2, wherein the material of the cubical container is a cotton and polyester blend fabric.

9. The golf ball warming device of claim 8, wherein the material has a heat set crease resistant finish.

10. The golf ball warming device of claim 8, wherein the fabric has a Grieg Goods thread count of $^{80}/_{42}$.

11. The golf ball warming device of claim 2, wherein the cubical container is constructed from a one piece die cut material.

* * * * *